US011657946B2

(12) United States Patent
Matsuura

(10) Patent No.: US 11,657,946 B2
(45) Date of Patent: May 23, 2023

(54) COMMON MODE CHOKE COIL

(71) Applicant: Murata Manufacturing Co., Ltd., Kyoto-fu (JP)

(72) Inventor: Kouhei Matsuura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 358 days.

(21) Appl. No.: 17/084,321

(22) Filed: Oct. 29, 2020

(65) Prior Publication Data

US 2021/0142938 A1 May 13, 2021

(30) Foreign Application Priority Data

Nov. 7, 2019 (JP) ..... JP2019-202352

(51) Int. Cl.

| | |
|---|---|
| ***H01F 27/28*** | (2006.01) |
| ***H01F 17/00*** | (2006.01) |
| ***H01F 27/29*** | (2006.01) |
| ***H01F 17/03*** | (2006.01) |
| ***H01F 41/04*** | (2006.01) |

(52) U.S. Cl.

CPC ..... *H01F 17/0013* (2013.01); *H01F 17/03* (2013.01); *H01F 27/29* (2013.01); *H01F 41/041* (2013.01); *H01F 2017/002* (2013.01); *H01F 2017/0093* (2013.01)

(58) Field of Classification Search

USPC ..... 336/192, 200, 232, 198

See application file for complete search history.

(56) References Cited

U.S. PATENT DOCUMENTS

| | | | | |
|---|---|---|---|---|
| 2005/0128042 | A1 | 6/2005 | Tomohiro et al. | |
| 2006/0158301 | A1* | 7/2006 | Shinkai | H01F 17/0013 336/232 |
| 2013/0169399 | A1* | 7/2013 | Yoo | H01F 17/0013 427/125 |

(Continued)

FOREIGN PATENT DOCUMENTS

| | | | |
|---|---|---|---|
| CN | 1627456 | A | 6/2005 |
| CN | 104184430 | A | 12/2014 |

(Continued)

OTHER PUBLICATIONS

An Office Action mailed by the Korean Intellectual Property Office dated Oct. 9, 2021, which corresponds to Korean Patent Application No. 10-2020-0146103 and is related to U.S. Appl. No. 17/084,321 with English language translation.

*Primary Examiner* — Shawki S Ismail
*Assistant Examiner* — Kazi S Hossain
(74) *Attorney, Agent, or Firm* — Studebaker & Brackett PC

(57) ABSTRACT

A common mode choke coil includes an element body formed by stacking a plurality of insulating layers in a height direction, first and second coils that are built into the element body, first and second outer electrodes that are provided on surfaces of the element body so as to face each other in a width direction and are electrically connected to one end and the other end of the first coil, and third and fourth outer electrodes that are provided on surfaces of the element body so as to face each other in the width direction and are electrically connected to one end and the other end of the second coil. When L1 and L2 are the inductances of the first and second coils, $100\times|L1-L2|/((L1+L2)/2)\leq 5$ at 1 GHz.

16 Claims, 8 Drawing Sheets

(56) References Cited

U.S. PATENT DOCUMENTS

| | | | | |
|---|---|---|---|---|
| 2014/0347773 | A1 | 11/2014 | Park et al. | |
| 2017/0338034 | A1* | 11/2017 | Yun | H03H 7/466 |
| 2019/0103216 | A1* | 4/2019 | Matsuda | H01F 17/0013 |

FOREIGN PATENT DOCUMENTS

| | | | |
|---|---|---|---|
| JP | 2000-331833 | A | 11/2000 |
| JP | 2003-124027 | A | 4/2003 |
| JP | 2004-095860 | A | 3/2004 |
| JP | 2006-186210 | A | 7/2006 |
| JP | 2006-245369 | A | 9/2006 |
| JP | 2015-005628 | A | 1/2015 |
| JP | 2016-144115 | A | 8/2016 |
| JP | 2017-069408 | A | 4/2017 |
| JP | 2017-092434 | A | 5/2017 |
| JP | 2016-079903 | A1 | 8/2017 |
| JP | 2019-36698 | A | 3/2019 |
| KR | 10-0644788 | B1 | 11/2006 |
| KR | 10-1445741 | B1 | 10/2014 |
| KR | 10-2019-0064436 | A | 6/2019 |
| WO | 2015029976 | A1 | 3/2015 |

* cited by examiner

COMMON MODE CHOKE COIL

CROSS-REFERENCE TO RELATED APPLICATION

This application claims benefit of priority to Japanese Patent Application No. 2019-202352, filed Nov. 7, 2019, the entire content of which is incorporated herein by reference.

BACKGROUND

Technical Field

The present disclosure relates to a common mode choke coil.

Background Art

A common mode choke coil is known as one type of circuit noise filter. For example, International Publication No. 2015/029976 discloses a common mode choke coil that includes a body composed of an insulator, a plurality of coil conductors that are provided in the body and each consist of a spiral-shaped coil portion and an extension portion that is connected to the coil portion and extends in a straight line, a plurality of outer electrodes that are provided on a surface of the body, and a plurality of outer pads that connect the extension portions and the outer electrodes to each other. In each coil conductor, the angle formed between the coil portion and the extension portion at the contact point where the coil portion and the extension portion are connected to each other is set to be an obtuse angle.

In the common mode choke coil disclosed in International Publication No. 2015/029976, the angle formed between the coil portion and the extension portion in each coil conductor at the contact point where the coil portion and the extension portion are connected to each other is set to be an obtuse angle in order suppress degradation of inductance caused by some magnetic flux generated by the coil conductors being canceled out. However, the two coils in this common mode choke coil have significantly different path lengths from each other, and therefore there is a risk of the inductances of the two coils being greatly shifted from each other. Therefore, when such a common mode choke coil is incorporated into a circuit, among the lines corresponding to the individual coils, the signal-waveform sharpness of one line may be weakened as a result of the characteristic impedance between that signal line and ground (GND) being greatly shifted. In other words, the noise suppression function provided by the common mode choke coil may be reduced.

SUMMARY

Accordingly, the present disclosure provides a common mode choke coil that has an excellent noise suppression function.

A preferred embodiment of the present disclosure provides a common mode choke coil that includes an element body formed by stacking a plurality of insulating layers in a height direction; a first coil and a second coil that are built into the element body; a first outer electrode that is provided on a surface of the element body and is electrically connected to one end of the first coil; a second outer electrode that is provided on a surface of the element body at a position that faces the first outer electrode in a width direction that is perpendicular to the height direction and that is electrically connected to another end of the first coil;

a third outer electrode that is provided on a surface of the element body and is electrically connected to one end of the second coil; and a fourth outer electrode that is provided on a surface of the element body at a position that faces the third outer electrode in the width direction and that is electrically connected to another end of the second coil. When L1 is an inductance of the first coil and L2 is an inductance of the second coil, $100\times|L1-L2|/((L1+L2)/2)\leq 5$ at 1 GHz.

According to the preferred embodiment of the present disclosure, a common mode choke coil having an excellent noise suppression function can be provided.

Other features, elements, characteristics and advantages of the present disclosure will become more apparent from the following detailed description of preferred embodiments of the present disclosure with reference to the attached drawings.

DETAILED DESCRIPTION

Hereafter, a common mode choke coil of an embodiment of the present disclosure will be described. Note that the present disclosure is not limited to the following configurations and may be modified as appropriate within a range that does not depart from the gist of the present disclosure. Furthermore, combinations of a plurality of the preferred configurations described below are also included in the scope of the present disclosure.

Common Mode Choke Coil

Figure 1:
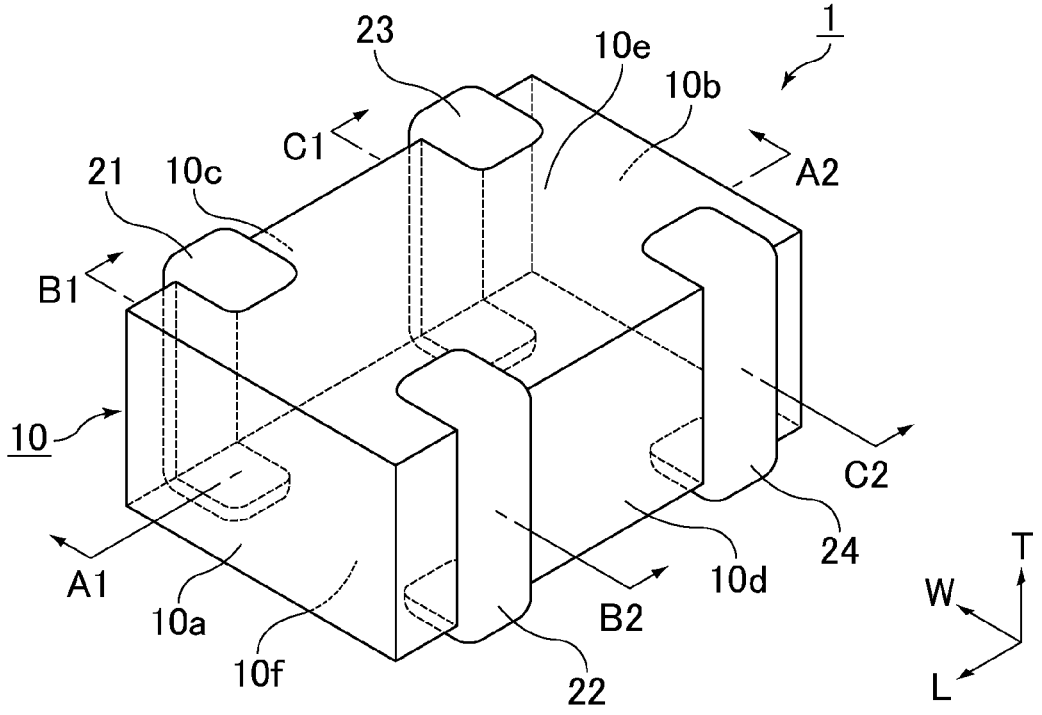
FIG. 1 is a schematic perspective view illustrating an example of a common mode choke coil of an embodiment of the present disclosure.

FIG. 1 is a schematic perspective view illustrating an example of a common mode choke coil of an embodiment of the present disclosure.

In this specification, a length direction, a width direction, and a height direction of the common mode choke coil are the directions respectively defined by arrows L, W, and T, as indicated in FIG. 1 and so on. The length direction L, the width direction W, and the height direction T are perpendicular to each other.

As illustrated in FIG. 1, a common mode choke coil 1 includes an element body 10, a first outer electrode 21, a second outer electrode 22, a third outer electrode 23, and a fourth outer electrode 24. In addition, although not illustrated in FIG. 1, the common mode choke coil 1 also includes a first coil and a second coil that are built into the element body 10, as described later.

The element body 10 is, for example, substantially shaped like a rectangular parallelepiped having six surfaces as illustrated in FIG. 1. The element body 10 has a first end surface 10*a* and a second end surface 10*b*, which face each other in the length direction L, a first side surface 10*c* and a second side surface 10*d*, which face each other in the width direction W, and a first main surface 10*e* and a second main surface 10*f*, which face each other in the height direction T. The first main surface 10*e* or the second main surface 10*f* is used as a mounting surface when the common mode choke coil 1 is mounted on a substrate.

Corner portions and edge portions of the element body 10 are preferably rounded. "Corner portions" of the element body 10 are parts where three surfaces of the element body 10 intersect. "Edge portions" of the element body 10 are parts where two surfaces of the element body 10 intersect.

As described later, the element body 10 is formed by stacking a plurality of insulating layers in the height direction T.

The insulating layers constituting the element body 10 are preferably composed of a glass ceramic material. Thus, the radio-frequency characteristics of the common mode choke coil 1 are improved.

The glass ceramic material preferably includes a glass material containing at least K, B, and Si.

The glass material preferably contains K at 0.5 to 5 wt % expressed in terms of $K_2O$, B at 10 to 25 wt % expressed in terms of $B_2O_3$, Si at 70 to 85 wt % expressed in terms of $SiO_2$, and Al at 0 to 5 wt % expressed in terms of $Al_2O_3$.

The glass-ceramic material preferably contains $SiO_2$ (quartz) and $Al_2O_3$ (alumina) as fillers in addition to the glass material described above. In this case, the glass ceramic material preferably contains the glass material at 60 to 66 wt %, $SiO_2$ at 34 to 37 wt % as a filler, and $Al_2O_3$ at 0.5 to 4 wt % as a filler. The radio-frequency characteristics of the common mode choke coil 1 are improved as a result of the glass ceramic material including $SiO_2$ as a filler. Furthermore, the mechanical strength of the element body 10 is improved as a result of the glass ceramic material including $Al_2O_3$ as a filler.

The first outer electrode 21 is provided on the surface of the element body 10, more specifically, the first outer electrode 21 extends along part of each of the first side surface 10*c*, the first main surface 10*e*, and the second main surface 10*f*.

The second outer electrode 22 is provided on the surface of the element body 10, more specifically, the second outer electrode 22 extends along part of each of the second side surface 10*d*, the first main surface 10*e*, and the second main surface 10*f*. In addition, the second outer electrode 22 is provided at a position facing the first outer electrode 21 in the width direction W.

The third outer electrode 23 is provided on the surface of the element body 10, more specifically, the third outer electrode 23 extends along part of each of the first side surface 10*c*, the first main surface 10*e*, and the second main surface 10*f* at a position spaced apart from the first outer electrode 21.

The fourth outer electrode 24 is provided on the surface of the element body 10, more specifically, the fourth outer electrode 24 extends along part of each of the second side surface 10*d*, the first main surface 10*e*, and the second main surface 10*f* at a position spaced apart from the second outer electrode 22. In addition, the fourth outer electrode 24 is provided at a position facing the third outer electrode 23 in the width direction W.

The first outer electrode 21, the second outer electrode 22, the third outer electrode 23, and the fourth outer electrode 24 may each have a single-layer structure or a multilayer structure.

In the case where the first outer electrode 21, the second outer electrode 22, the third outer electrode 23, and the fourth outer electrode 24 each have a single-layer structure, for example, Ag, Au, Cu, Pd, Ni, and Al or an alloy of any of these metals may be used as the material forming the outer electrodes.

In the case where the first outer electrode 21, the second outer electrode 22, the third outer electrode 23, and the fourth outer electrode 24 each have a multilayer structure, each outer electrode may for example include a base electrode layer containing Ag, a Ni plating film, and a Sn plating film stacked in this order from the surface of the element body 10.

Figure 2:
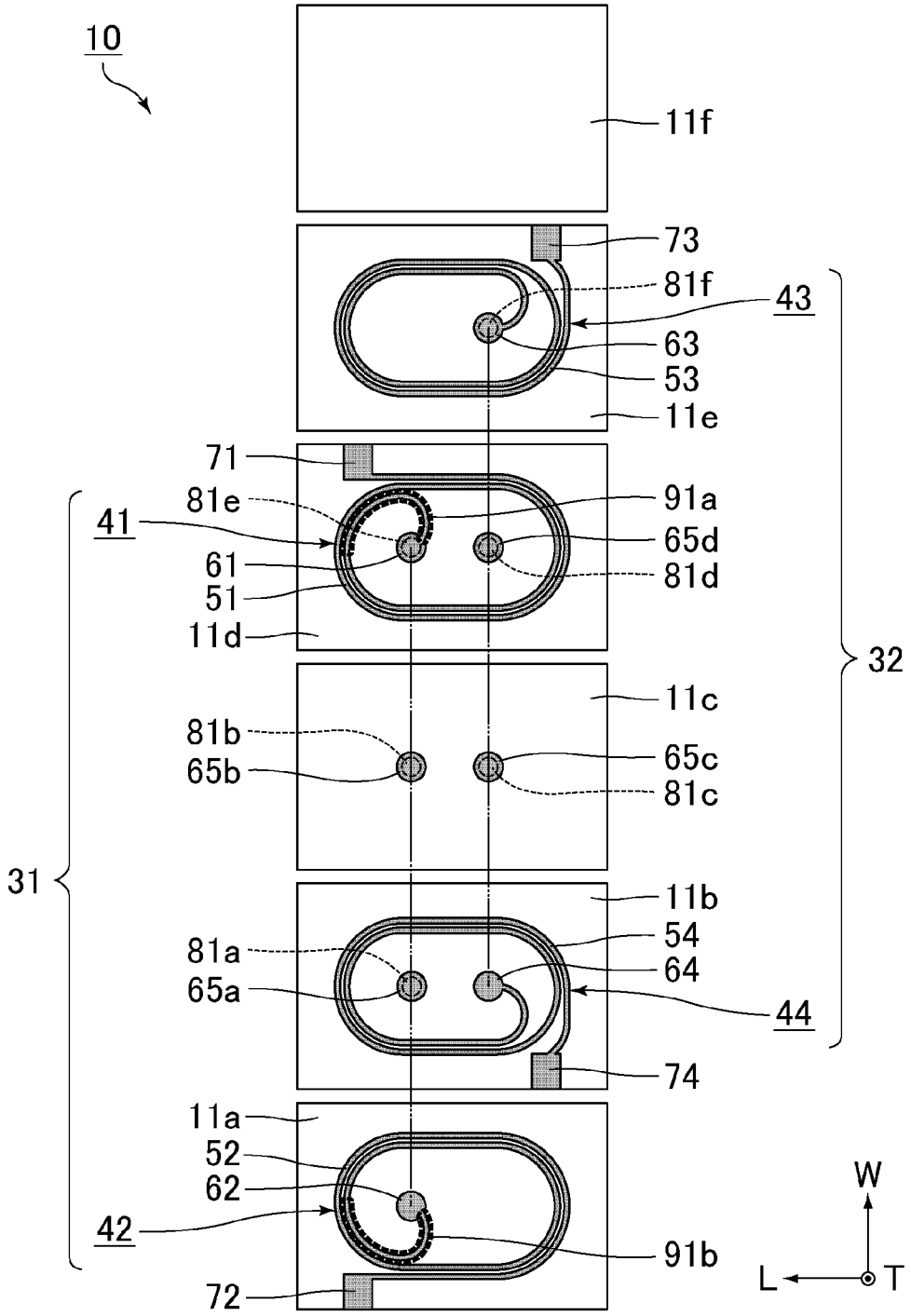
FIG. 2 is an exploded schematic plan view illustrating an example of the internal structure of an element body in FIG. 1.
Figure 3:
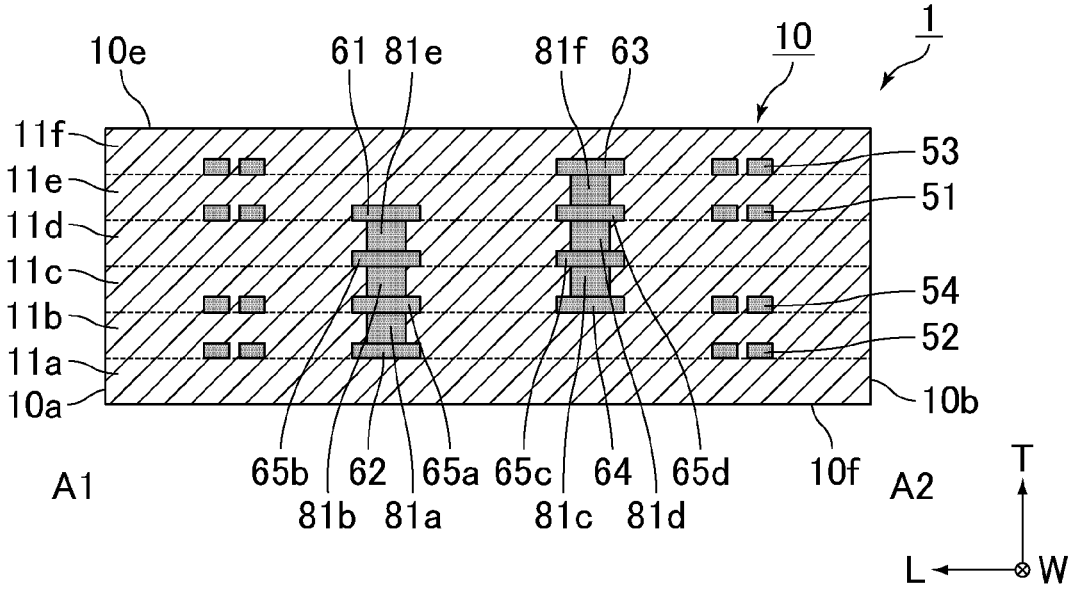
FIG. 3 is a schematic sectional view illustrating a cross section taken along line A1-A2 in FIG. 1.
Figure 4:
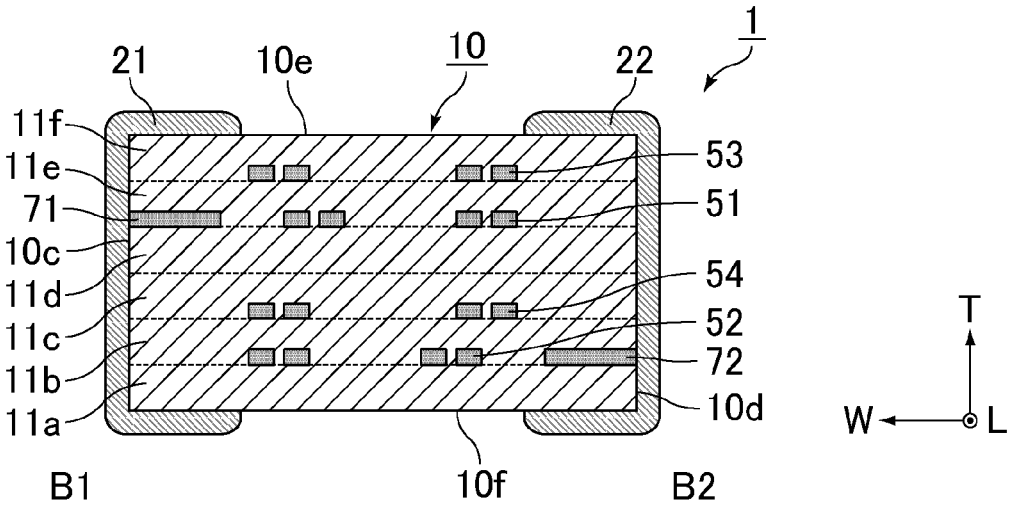
FIG. 4 is a schematic sectional view illustrating a cross section taken along line B1-B2 in FIG. 1.
Figure 5:
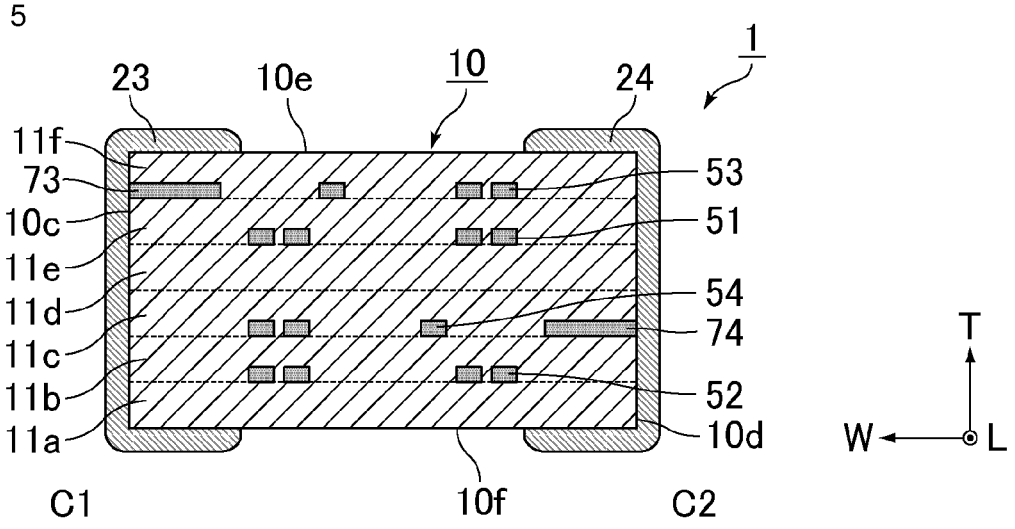
FIG. 5 is a schematic sectional view illustrating a cross section taken along line C1-C2 in FIG. 1.

FIG. 2 is an exploded schematic plan view illustrating an example of the internal structure of the element body in FIG. 1. FIG. 3 is a schematic sectional view illustrating a cross section taken along line A1-A2 in FIG. 1. FIG. 4 is a schematic sectional view illustrating a cross section taken along line B1-B2 in FIG. 1. FIG. 5 is a schematic sectional view illustrating a cross section taken along line C1-C2 in FIG. 1.

As illustrated in FIGS. 2, 3, 4, and 5, the element body 10 is formed by stacking, in the height direction T, a plurality of insulating layers including an insulating layer 11*a*, an insulating layer 11*b*, an insulating layer 11*c*, an insulating layer 11*d*, and an insulating layer 11*e*. The insulating layer 11*a* is located on the side of the element body 10 near the second main surface 10*f* and the insulating layer 11*e* is located on the side of the element body 10 near the first main surface 10*e*. In FIGS. 3, 4, and 5, the boundaries between these insulating layers are illustrated as dotted lines for the sake of explanation but the boundaries may not be clearly visible in reality.

The insulating layer 11*a*, the insulating layer 11*b*, the insulating layer 11*c*, the insulating layer 11*d*, and the insulating layer 11*e* are preferably formed of the same material.

In the element body 10, at least one insulating layer having no conductor portions such as coil conductors, extension electrodes, and via conductors may be stacked on at least either of the side of the insulating layer 11*a* near the second main surface 10*f* and the side of the insulating layer 11*e* near the first main surface 10*e*. For example, in the element body 10, an insulating layer 11*f* may be stacked on the side of the insulating layer 11*e* near the first main surface 10*e*, as illustrated in FIGS. 2, 3, 4, and 5. It is preferable that this additional insulating layer 11*f* be composed of the same material as the insulating layer 11*a*, the insulating layer 11*b*, the insulating layer 11*c*, the insulating layer 11*d*, and the insulating layer 11*e*.

A first coil 31 and a second coil 32 are built into the element body 10.

The first coil 31 is formed by stacking a plurality of coil conductors, including a first coil conductor and a second coil conductor, together with insulating layers in the height direction T and electrically connecting the coil conductors to each other. In addition, the second coil 32 is formed by stacking a plurality of coil conductors, including a third coil conductor and a fourth coil conductor, together with insulating layers in the height direction T and electrically connecting the coil conductors to each other. This is described in more detail below.

A second coil conductor 42 is provided on a main surface of the insulating layer 11*a*. The second coil conductor 42 includes a second line portion 52 and a second land portion 62. One end of the second line portion 52 is connected to a second extension electrode 72 that extends from the second outer electrode 22. The other end of the second line portion 52 is connected to the second land portion 62.

A fourth coil conductor 44 is provided on a main surface of the insulating layer 11*b*. The fourth coil conductor 44 includes a fourth line portion 54 and a fourth land portion 64. One end of the fourth line portion 54 is connected to a fourth extension electrode 74 that extends from the fourth outer electrode 24. The other end of the fourth line portion 54 is connected to the fourth land portion 64.

A land portion 65*a* is provided on the main surface of the insulating layer 11*b* at a position that is spaced apart from the fourth land portion 64. In addition, a via conductor 81*a* that penetrates through the insulating layer 11*b* in the height direction T is provided at a position that overlaps the land portion 65*a*.

A land portion 65*b* is provided on a main surface of the insulating layer 11*c*. In addition, a via conductor 81*b* that penetrates through the insulating layer 11*c* in the height direction T is provided at a position that overlaps the land portion 65*b*.

A land portion 65*c* is provided on the main surface of the insulating layer 11*c* at a position that is spaced apart from the land portion 65*b*. In addition, a via conductor 81*c* that penetrates through the insulating layer 11*c* in the height direction T is provided at a position that overlaps the land portion 65*c*.

A first coil conductor 41 is provided on a main surface of the insulating layer 11*d*. The first coil conductor 41 includes a first line portion 51 and a first land portion 61. One end of the first line portion 51 is connected to a first extension electrode 71 that extends from the first outer electrode 21. The other end of the first line portion 51 is connected to the first land portion 61.

A via conductor 81*e* that penetrates through the insulating layer 11*d* in the height direction T is provided at a position that overlaps the first land portion 61.

A land portion 65*d* is provided on the main surface of the insulating layer 11*d* at a position that is spaced apart from the first land portion 61. In addition, a via conductor 81*d* that penetrates through the insulating layer 11*d* in the height direction T is provided at a position that overlaps the land portion 65*d*.

A third coil conductor 43 is provided on a main surface of the insulating layer 11*e*. The third coil conductor 43 includes a third line portion 53 and a third land portion 63. One end of the third line portion 53 is connected to a third extension electrode 73 that extends from the third outer electrode 23. The other end of the third line portion 53 is connected to the third land portion 63.

A via conductor 81*f* that penetrates through the insulating layer 11*e* in the height direction T is provided at a position that overlaps the third land portion 63.

As described above, when the insulating layer 11*a*, the insulating layer 11*b*, the insulating layer 11*c*, the insulating layer 11*d*, and the insulating layer 11*e* having the conductor portions such as the coil conductors, extension electrodes, and the via conductors are sequentially stacked in the height direction T, the first land portion 61 of the first coil conductor 41 is electrically connected to the second land portion 62 of the second coil conductor 42 by the via conductor 81*e*, the land portion 65*b*, the via conductor 81*b*, the land portion 65*a*, and the via conductor 81*a* in this order, as illustrated in FIGS. 2 and 3. Thus, the first coil 31 is formed. Furthermore, the third land portion 63 of the third coil conductor 43 is electrically connected to the fourth land portion 64 of the fourth coil conductor 44 by the via conductor 81*f*, the land portion 65*d*, the via conductor 81*d*, the land portion 65*c*, and the via conductor 81*c* in this order. Thus, the second coil 32 is formed.

As illustrated in FIGS. 2 and 4, one end of the first coil 31 (one end of first line portion 51) is electrically connected to the first outer electrode 21 via the first extension electrode 71. The other end of the first coil 31 (one end of second line portion 52) is electrically connected to the second outer electrode 22 via the second extension electrode 72.

As illustrated in FIGS. 2 and 5, one end of the second coil 32 (one end of third line portion 53) is electrically connected to the third outer electrode 23 via the third extension electrode 73. The other end of the second coil 32 (one end of fourth line portion 54) is electrically connected to the fourth outer electrode 24 via the fourth extension electrode 74.

The coil axes of the first coil 31 and the second coil 32 extend in the height direction T through the centers of the cross-sectional shape of the coils in a sectional view in the height direction T.

In a sectional view in the height direction T, the first coil 31 and the second coil 32 may have outer shapes consisting of substantially straight line portions and curved line portions as illustrated in FIG. 2 or may instead have substantially circular or polygonal outer shapes.

In a sectional view in the height direction T, the first land portion 61, the second land portion 62, the third land portion 63, the fourth land portion 64, the land portion 65*a*, the land portion 65*b*, the land portion 65*c*, and the land portion 65*d* may have substantially circular shapes as illustrated in FIG. 2 or may have substantially polygonal shapes.

For example, Ag, Au, Cu, Pd, Ni, Al, or an alloy of any of these metals may be used as the material forming the first line portion 51, the second line portion 52, the third line portion 53, the fourth line portion 54, the first land portion 61, the second land portion 62, the third land portion 63, the fourth land portion 64, the land portion 65*a*, the land portion 65*b*, the land portion 65*c*, the land portion 65*d*, the first extension electrode 71, the second extension electrode 72, the third extension electrode 73, the fourth extension electrode 74, the via conductor 81*a*, the via conductor 81*b*, the via conductor 81*c*, the via conductor 81*d*, the via conductor 81*e*, and the via conductor 81*f*.

In the common mode choke coil 1, when L1 is the inductance of the first coil 31 and L2 is the inductance of the second coil 32, $100\times|L1-L2|/((L1+L2)/2)\leq 5$ at 1 GHz. "$100\times|L1-L2|/((L1+L2)/2)$" expresses the degree of deviation between the inductance of the first coil 31 and the inductance of the second coil 32. The common mode choke coil 1 having an excellent noise suppression function particularly in a radio-frequency band can be realized by setting the degree of deviation between the inductances to be less than or equal to 5%.

In the common mode choke coil 1, at 1 GHz, it is preferable that $100\times|L1-L2|/((L1+L2)/2)\leq 4$ and it is particularly preferable that $100\times|L1-L2|/((L1+L2)/2)=0$, i.e., $L1=L2$.

In the common mode choke coil 1, at 100 MHz, it is preferable that $100\times|L1-L2|/((L1+L2)/2)\leq 3$, it is more preferable that $100\times|L1-L2|/((L1+L2)/2)\leq 1$, and it is particularly preferable that $100\times|L1-L2|/((L1+L2)/2)=0$, i.e., $L1=L2$.

L1 and L2 may lie in a range from 1 nH to 10 nH. The effect of the deviation between the inductance of the first coil 31 and the inductance of the second coil 32 on the noise suppression function tends to be more pronounced when the inductances of the first coil 31 and the second coil 32 are small. In contrast, the noise suppression function of the common mode choke coil 1 is excellent even when the inductances of the first coil 31 and the second coil 32 are small.

Figure 6:
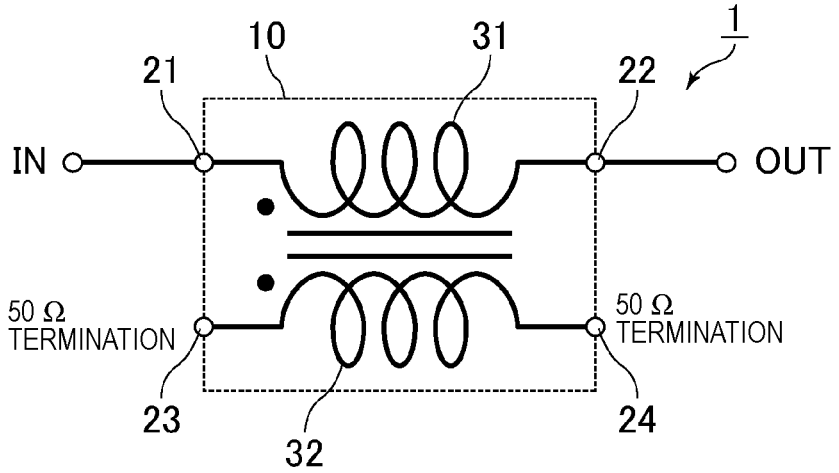
FIG. 6 is a schematic diagram for describing a method for measuring the inductances of a first coil and a second coil.
Figure 7:
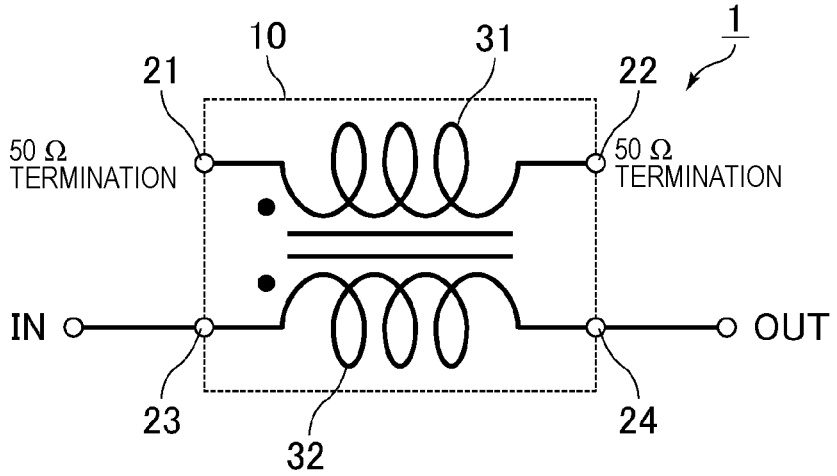
FIG. 7 is a schematic diagram for describing the method for measuring the inductances of the first coil and the second coil.

The inductances of the first coil 31 and the second coil 32 are measured in the following way. FIGS. 6 and 7 are schematic diagrams for describing a method for measuring the inductances of the first coil and the second coil.

First, as illustrated in FIG. 6, the first outer electrode 21, which is electrically connected to one end of the first coil 31, is connected to an input terminal (IN) of a network analyzer and the second outer electrode 22, which is electrically connected to the other end of the first coil 31, is connected to an output terminal (OUT) of the network analyzer. In addition, as illustrated in FIG. 6, the third outer electrode 23, which is electrically connected to one end of the second coil 32, and the fourth outer electrode 24, which is electrically connected to the other end of the second coil 32, are each connected to a 50Ω termination resistor. The inductance of the first coil 31 is measured with the common mode choke coil 1 connected to the network analyzer in this way.

Next, as illustrated in FIG. 7, the third outer electrode 23, which is electrically connected to one end of the second coil 32, is connected to the input terminal (IN) of the network analyzer and the fourth outer electrode 24, which is electrically connected to the other end of the second coil 32, is connected to the output terminal (OUT) of the network analyzer. In addition, as illustrated in FIG. 7, the first outer electrode 21, which is electrically connected to one end of the first coil 31, and the second outer electrode 22, which is electrically connected to the other end of the first coil 31, are each connected to a 50Ω termination resistor. The inductance of the second coil 32 is measured with the common mode choke coil 1 connected to the network analyzer in this way.

For example, the network analyzer "E5071C" manufactured by Keysight Technologies is used as the network analyzer.

In the common mode choke coil 1, it is preferable that $100\times(R1-R2)/R1\leq 3$ when $R1\geq R2$ and that $100\times(R2-R1)/R2\leq 3$ when $R2\geq R1$, where R1 is the path length of the first coil 31 and R2 is the path length of the second coil 32. "$100\times(R1-R2)/R1$" and "$100\times(R2-R1)/R2$" express the degree of deviation between the path length of the first coil 31 and the path length of the second coil 32. The degree of deviation between the inductance of the first coil 31 and the inductance of the second coil 32 becomes sufficiently small and as a result the noise suppression function of the common mode choke coil 1 is markedly improved by making the degree of path length deviation less than or equal to 3%.

The path length of the first coil 31 means the total length of the wiring line connected between the first extension electrode 71 and the second extension electrode 72, more specifically, the length of the line passing through the first line portion 51, the first land portion 61, the via conductor 81*e*, the land portion 65*b*, the via conductor 81*b*, the land portion 65*a*, the via conductor 81*a*, the second land portion 62, and the second line portion 52. The path length of the second coil 32 means the total length of the wiring line connected between the third extension electrode 73 and the fourth extension electrode 74, more specifically, the length of the line passing through the third line portion 53, the third land portion 63, the via conductor 81*f*, the land portion 65*d*, the via conductor 81*d*, the land portion 65*c*, the via conductor 81*c*, the fourth land portion 64, and the fourth line portion 54.

The path length of the first coil 31 and the path length of the second coil 32 are determined in the following manner. First, the common mode choke coil 1 (element body 10) is ground down so as to expose an LW cross section that is parallel to the length direction L and the width direction W. Then, the length of the line passing through the center of the width of each line portion and each land portion is measured for each LW section, as illustrated in FIG. 2, using a microscope. In addition, the common mode choke coil 1 (element body 10) is ground down so as to expose an LT cross section that is parallel to the length direction L and the height direction T. Then, the dimension of each via conductor in the height direction T is measured using the microscope in the LT cross section as illustrated in FIG. 3. The dimension of each via conductor in the height direction T may be measured in a WT cross section that is parallel to the width direction W and the height direction T. The path length of the first coil 31 and the path length of the second coil 32 are determined by adding together all of the thus-obtained measured values for the first coil 31 and the second coil 32.

In the common mode choke coil 1, it is desirable to reduce the difference between the path length of the first coil 31 and the path length of the second coil 32, as described above, from the viewpoint of reducing the deviation between the inductance of the first coil 31 and the inductance of the second coil 32. A specific example of a method for reducing the difference between the path length of the first coil 31 and the path length of the second coil 32 will be described below.

Figure 8:
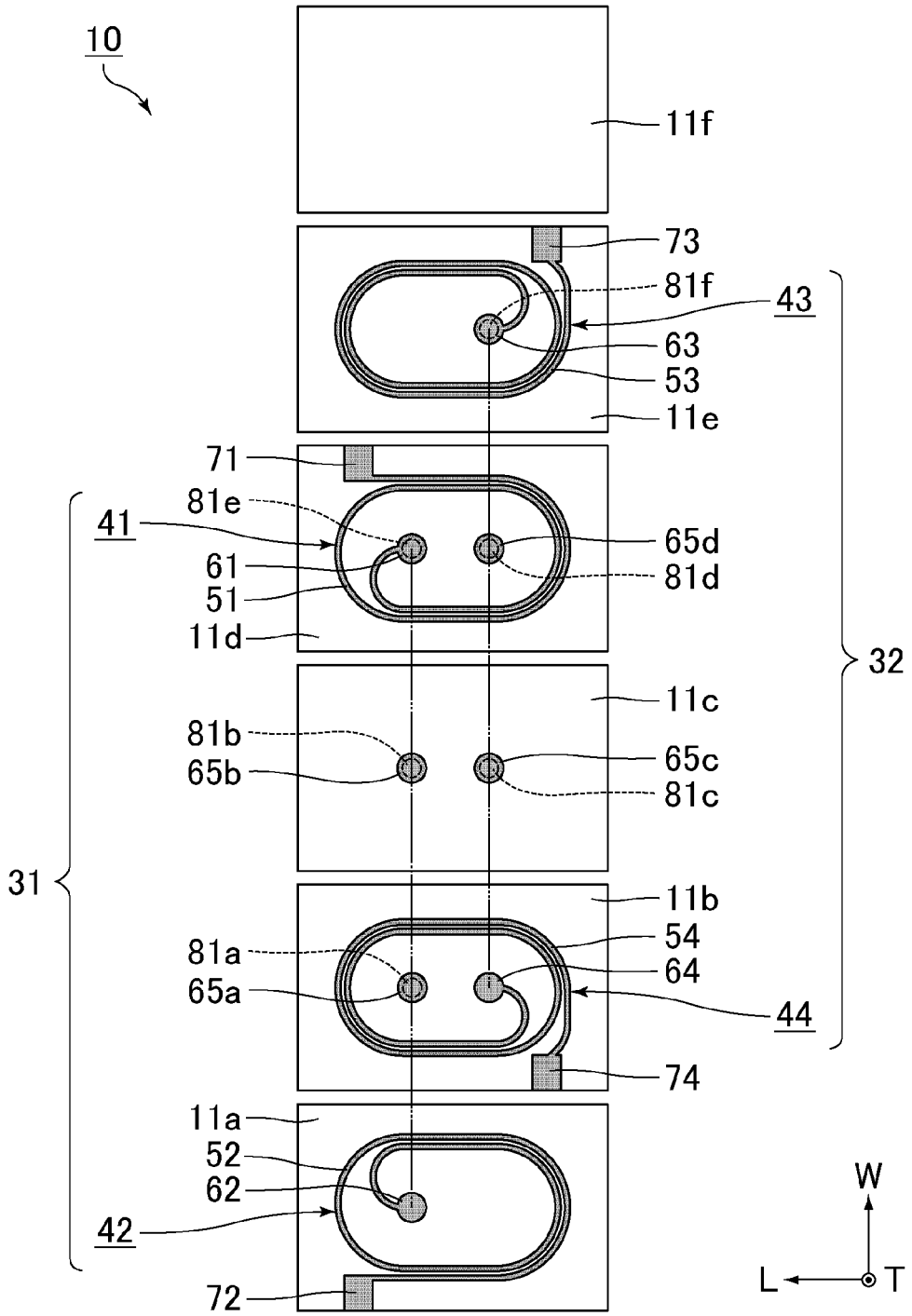
FIG. 8 is an exploded schematic plan view illustrating the internal structure of an element body of a common mode choke coil of the related art.

First, description will be given of a common mode choke coil of the related art, which will be compared with the present disclosure. FIG. 8 is an exploded schematic plan view illustrating the internal structure of an element body of the common mode choke coil of the related art. As illustrated in FIG. 8, in the common mode choke coil of the related art, the length of the first line portion 51 and the length of the second line portion 52 are each considerably shorter than those in the configuration illustrated in FIG. 2, and this results in the path length of the first coil 31 being considerably shorter than the path length of the second coil 32. In other respects, the common mode choke coil of the related art illustrated in FIG. 8 is similar to the example of a common mode choke coil of the embodiment of the present disclosure illustrated in FIG. 2.

In contrast to the common mode choke coil of the related art illustrated in FIG. 8, in the example common mode choke coil of the embodiment of the present disclosure illustrated in FIG. 2, a path adjusting portion 91*a* (part surrounded by dotted lines) is provided for the first line portion 51 and a path adjusting portion 91*b* (part surrounded by dotted lines) is provided for the second line portion 52, i.e., the path length of the first coil 31 is increased. Thus, in the example common mode choke coil of the embodiment of the present disclosure illustrated in FIG. 2, the difference between the path length of the first coil 31 and the path length of the second coil 32 is reduced.

In the example common mode choke coil of the embodiment of the present disclosure illustrated in FIG. 2, as a result of the first line portion 51 being provided with the path adjusting portion 91*a* and the second line portion 52 being provided with the path adjusting portion 91*b*, the manner in which the first line portion 51 is routed to the first land portion 61 and the manner in which the second line portion 52 is routed to the second land portion 62 are changed compared with the common mode choke coil of the related art illustrated in FIG. 8.

More specifically, in the example common mode choke coil of the embodiment of the present disclosure illustrated in FIG. 2, the other end of the first line portion 51 is connected to the first land portion 61 from a side near the first extension electrode 71 in the width direction W and the other end of the second line portion 52 is connected to the second land portion 62 from a side near the second extension electrode 72 in the width direction W. In addition, looking at the second coil 32, the other end of the third line portion 53 is connected to the third land portion 63 from a side near the third extension electrode 73 in the width direction W and the other end of the fourth line portion 54 is connected to the fourth land portion 64 from a side near the fourth extension electrode 74 in the width direction W.

In contrast, in the common mode choke coil of the related art illustrated in FIG. 8, the other end of the first line portion 51 is connected to the first land portion 61 from the opposite side from where the first extension electrode 71 is located in the width direction W and the other end of the second line portion 52 is connected to the second land portion 62 from the opposite side from where the second extension electrode 72 is located in the width direction W.

As illustrated in FIG. 2, the path adjusting portion 91*a* and the path adjusting portion 91*b* are preferably shaped so as to generally follow the circumferential shape of the first coil 31, but may instead have a meandering shape.

The path adjusting portions are provided in the first coil 31 in the example common mode choke coil of the embodiment of the present disclosure illustrated in FIG. 2, but such path adjusting portions may instead be provided in the second coil 32 in the case where the path length of the second coil 32 is considerably shorter than the path length of the first coil 31 in the common mode choke coil of the related art.

A method of reducing the difference between the path length of the first coil 31 and the path length of the second coil 32 by providing path adjusting portions has been described, but the following method may also be used.

Figure 9:
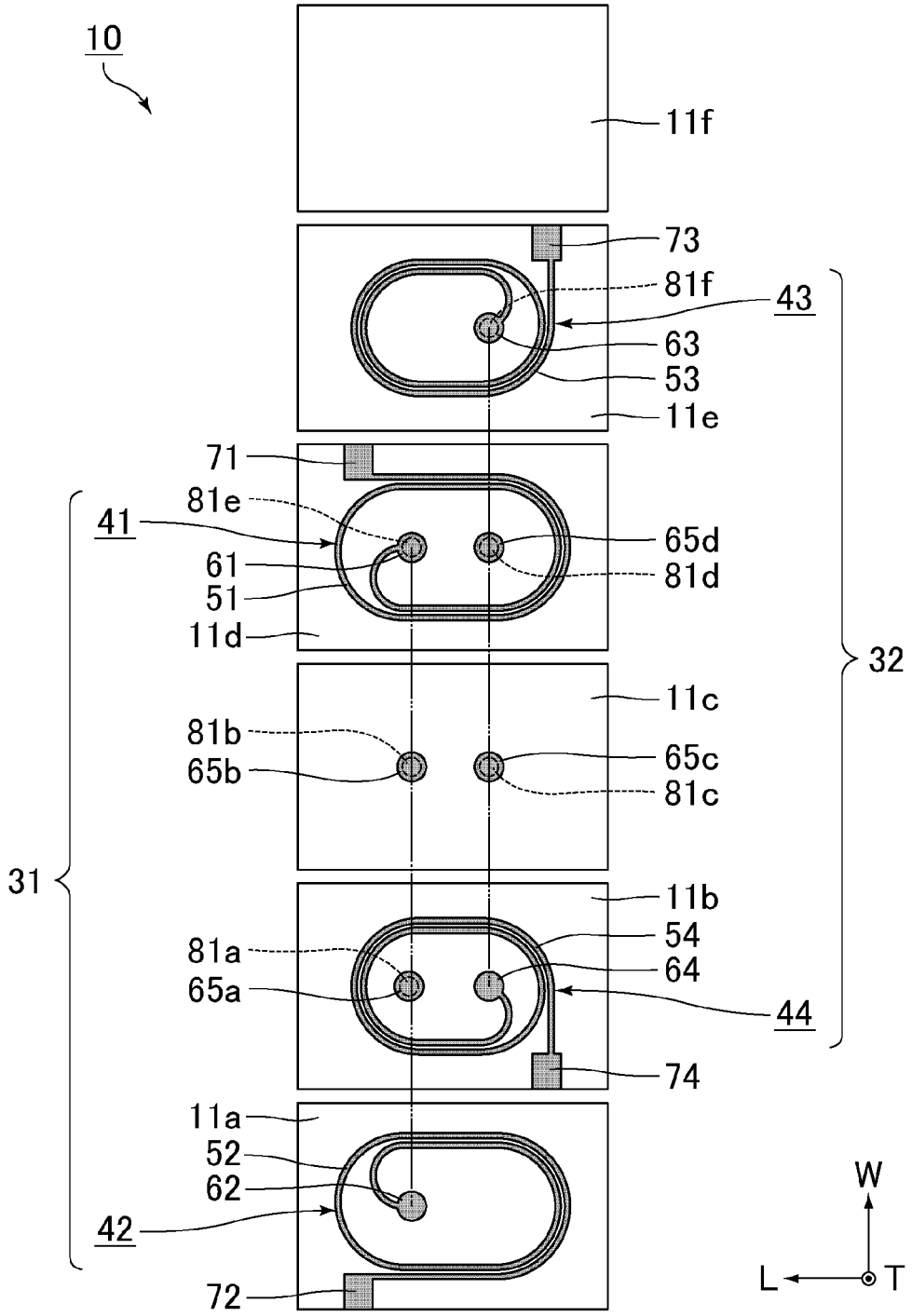
FIG. 9 is an exploded schematic plan view illustrating another example of the internal structure of the element body in FIG. 1.

FIG. 9 is an exploded schematic plan view illustrating another example of the internal structure of the element body in FIG. 1. In this other example of the common mode choke coil of the embodiment of the present disclosure illustrated in FIG. 9, the coil diameter of the second coil 32 is reduced without changing the number of turns of the second coil 32, in other words, the path length of the second coil 32 is made shorter compared with the common mode choke coil of the related art illustrated in FIG. 8. Thus, in this other example of the common mode choke coil of the embodiment of the present disclosure illustrated in FIG. 9, the difference between the path length of the first coil 31 and the path length of the second coil 32 is reduced.

In this other example of the common mode choke coil of the embodiment of the present disclosure illustrated in FIG. 9, the coil diameter of the second coil 32 is smaller than the coil diameter of the first coil 31. On the other hand, the coil diameter of the first coil 31 may be made smaller than that of the second coil 32 without changing the number of turns of the first coil 31 in the case where the path length of the second coil 32 is considerably shorter than the path length of the first coil 31 in the common mode choke coil of the related art. In summary, one coil diameter out of the coil diameter of the first coil 31 and the coil diameter of the second coil 32 may be made smaller than the other coil diameter.

The coil diameters (outer diameters) of the first coil 31 and the second coil 32 mean the diameters of area equivalent circles of the cross-sectional shapes (outer shapes) of the coils in a sectional view in the height direction T.

The number of turns of the first coil 31 and the number of turns of the second coil 32 may be less than or equal to five turns. The effect of the deviation between the inductance of the first coil 31 and the inductance of the second coil 32 on the noise suppression function tends to be more pronounced when the number of turns of the first coil 31 and the second coil 32 is small. In contrast, the common mode choke coil 1 has an excellent noise suppression function even when the number of turns of the first coil 31 and the second coil 32 is small Note that the number of turns of the first coil 31 and the number of turns of the second coil 32 may be greater than or equal to five turns.

It is preferable that the width of the first line portion 51, the width of the second line portion 52, the width of the third line portion 53, and the width of the fourth line portion 54 in a sectional view in the height direction T be identical from the viewpoint of reducing the deviation between the inductance of the first coil 31 and the inductance of the second coil 32.

In the common mode choke coil 1, at 1 GHz, it is preferable that $100\times|Z1-Z2|/((Z1+Z2)/2)\leq 5$, it is more preferable that $100\times|Z1-Z2|/((Z1+Z2)/2)\leq 4$, and it is particularly preferable that $100\times|Z1-Z2|/((Z1+Z2)/2)=0$, i.e., $Z1=Z2$, where Z1 is the impedance of the first coil 31 and Z2 is the impedance of the second coil 32. "$100\times|Z1-Z2|/((Z1+Z2)/2)$" expresses the degree of deviation between the impedance of the first coil 31 and the impedance of the second coil 32. By reducing this impedance deviation to be less than or equal to 5%, the noise suppression function of the common mode choke coil 1 becomes especially excellent, particularly in a radio-frequency band.

In the common mode choke coil 1, at 100 MHz, it is preferable that $100\times|Z1-Z2|/((Z1+Z2)/2)\leq 3$, it is more preferable that $100\times|Z1-Z2|/((Z1+Z2)/2)\leq 1$, and it is particularly preferable that $100\times|Z1-Z2|/((Z1+Z2)/2)=0$, i.e., $Z1=Z2$.

The impedances of the first coil 31 and the second coil 32 are measured in the same manner as in the inductance measurement method described with reference to FIGS. 6 and 7.

Method of Manufacturing Common Mode Choke Coil

Next, an example of a method of manufacturing the common mode choke coil of the embodiment of the present disclosure will be described.

Preparation of Glass Ceramic Material $K_2O$, $B_2O_3$, $SiO_2$, $Al_2O_3$, and so forth are mixed in a prescribed ratio. The resulting mixture is then melted by being subjected to firing. The resulting melted mixture is then quenched to produce a glass material. Next, a glass ceramic material is prepared by adding $SiO_2$ (quartz), $Al_2O_3$ (alumina), and so forth to the glass material as fillers.

Preparation of Glass Ceramic Sheets

A ceramic slurry is prepared by adding an organic binder such as polyvinyl butyral resin, an organic solvent such as ethanol or toluene, a plasticizer, and so forth to the glass ceramic material and mixing the materials. The ceramic slurry is then molded into a substantially sheet-like shape using a doctor blade method or the like and then punched to form prescribed shapes, thereby forming glass ceramic sheets.

Formation of Conductor Patterns

Coil-conductor conductor patterns corresponding to the coil conductors illustrated in FIG. 2, extension-electrode conductor patterns corresponding to the extension electrodes illustrated in FIG. 2, and via-conductor conductor patterns corresponding to the via conductors illustrated in FIG. 2 are formed on and in the individual glass ceramic sheets by screen printing or the like using a conductive paste such as Ag paste. When forming the via-conductor conductor patterns, via holes are formed in advance by irradiating prescribed portions of the glass ceramic sheets with a laser and then filling the via holes with a conductive paste.

Manufacture of Multilayer Block

The glass ceramic sheets on and in which conductor patterns have been formed are stacked in the order illustrated in FIG. 2. A prescribed number of glass ceramic sheets on and in which no conductor patterns have been formed may be stacked on the top and the bottom of the thus-formed multilayer body. After that, the resulting multilayer body is subjected to pressure bonding using a warm isostatic pressing (WIP) process or the like to produce a multilayer block.

Manufacture of Element Body

Individual chips are manufactured by cutting the multilayer block into pieces of a prescribed size by using a dicer or the like. After that, the individual chips are fired, whereby the glass ceramic sheets become the insulating layers and the coil-conductor conductor patterns, the extension-electrode conductor patterns, and the via-conductor conductor patterns become the coil conductors, the extension electrodes, and the via conductors. As a result, the element body having the first coil and the second coil built thereinto as illustrated in FIG. 2 is manufactured. The first extension electrode, which is connected to one end of the first coil, and the third extension electrode, which is connected to one end of the second coil, are exposed at the first side surface of the element body. The second extension electrode, which is connected to the other end of the first coil, and the fourth extension electrode, which is connected to the other end of the second coil, are exposed at the second side surface of the element body.

The corner portions and edge portions of the element body may be rounded by performing barrel polishing, for example.

Formation of Outer Electrodes

A conductive paste containing Ag and glass frit is applied to at least four locations on both side surfaces of the element body where the extension electrodes are exposed. Then, base electrode layers are formed by baking the thus-formed films. Next, a Ni plating film and a Sn plating film are sequentially formed on each base electrode layer by performing electrolytic plating. As a result, the first outer electrode, the second outer electrode, the third outer electrode, and the fourth outer electrode are formed as illustrated in FIG. 1.

The common mode choke coil of the embodiment of the present disclosure as exemplified in FIGS. 1, 2, and so on is manufactured as described above.

EXAMPLE

Hereafter, an example that discloses the common mode choke coil of the embodiment of the present disclosure in a more specific manner is described. The present disclosure is not limited to just the following example.

Example 1

A common mode choke coil of example 1 was manufactured using the following method.

Preparation of Glass Ceramic Material $K_2O$, $B_2O_3$, $SiO_2$, and $Al_2O_3$ were weighed in a prescribed ratio and mixed inside a platinum crucible. Then, the resulting mixture was melted by firing the mixture at a temperature in the range from 1500° C. to 1600° C. After that, the resulting melted mixture was quenched to produce a glass material.

Next, glass powder was prepared by pulverizing the glass material so that the average particle diameter $D_{50}$ was in a range from 1 μm to 3 μm. In addition, quartz powder and alumina powder with an average particle diameter $D_{50}$ in a range from 0.5 μm to 2.0 μm were prepared as fillers. Here, the average particle diameter $D_{50}$ is a particle diameter corresponding to a volume basis cumulative percentage of 50%. A glass ceramic material was then prepared by adding the quartz powder and the alumina powder to the glass powder as fillers.

Preparation of Glass Ceramic Sheets

A ceramic slurry was prepared by adding an organic binder such as polyvinyl butyral resin, an organic solvent such as ethanol or toluene, a plasticizer, and a PSZ medium to a ball mill together with the glass ceramic material and mixing the materials. Then, the ceramic slurry was molded into a substantially sheet-like shape with a thickness in a range from 20 μm to 30 μm using a doctor blade method or the like and then punched to form substantially rectangular shapes, thereby forming glass ceramic sheets.

Formation of Conductor Patterns

Coil-conductor conductor patterns corresponding to the coil conductors illustrated in FIG. 2, extension-electrode conductor patterns corresponding to the extension electrodes illustrated in FIG. 2, and via-conductor conductor patterns corresponding to the via conductors illustrated in FIG. 2 were formed on and in the individual glass ceramic sheets by screen printing or the like using a conductive paste such as a Ag paste. When forming the via-conductor conductor patterns, via holes were formed in advance by irradiating prescribed portions of the glass ceramic sheets with a laser and then filling the via holes with a conductive paste.

Manufacture of Multilayer Block

The glass ceramic sheets on and in which conductor patterns had been formed were stacked in the order illustrated in FIG. 2. A prescribed number of glass ceramic sheets on and in which no conductor patterns had been formed were stacked on the top and the bottom of the thus-formed multilayer body. After that, the resulting multilayer body was subjected to pressure bonding using a warm isostatic pressing process or the like to produce a multilayer block. The pressure bonding conditions were a temperature of 80° C. and a pressure of 100 MPa.

Manufacture of Element Body

The multilayer block was cut into pieces of a prescribed size using a dicer or the like, thereby manufacturing individual chips. After that, the individual chips were fired at 880° C. for 1.5 hours, whereby the glass ceramic sheets became the insulating layers and the coil-conductor conductor patterns, the extension-electrode conductor patterns, and the via-conductor conductor patterns became the coil conductors, the extension electrodes, and the via conductors. As a result, the element body having the first coil and the second coil built thereinto as illustrated in FIG. 2 was manufactured. The first extension electrode, which is connected to one end of the first coil, and the third extension electrode, which is connected to one end of the second coil, were exposed at the first side surface of the element body. The second extension electrode, which is connected to the other end of the first coil, and the fourth extension electrode, which is connected to the other end of the second coil, were exposed at the second side surface of the element body.

Next, the corner portions and edge portions of the element body were rounded by placing the element body in a rotary barrel machine along with a medium and performing barrel polishing.

Formation of Outer Electrodes

A conductive paste containing Ag and glass frit was applied to at least four locations on both side surfaces of the element body where the extension electrodes were exposed. Then, base electrode layers were formed by baking the resulting films at 810° C. for 1 minute. The thickness of the base electrode layers was 5 μm. Next, a Ni plating film and a Sn plating film were sequentially formed on each base electrode layer by performing electrolytic plating. The thickness of each Ni plating film and Sn plating film was 3 μm. As a result, the first outer electrode, the second outer electrode, the third outer electrode, and the fourth outer electrode were formed as illustrated in FIG. 1.

The common mode choke coil of example 1 was manufactured as described above. The size of the common mode choke coil of example 1 was 0.6 mm in the length direction, 0.5 mm in the width direction, and 0.3 mm in the height direction.

Comparative Example 1

A common mode choke coil of comparative example 1 was manufactured in the same manner as the common mode choke coil of example 1 except that the element body in which the first coil and the second coil were built in as illustrated in FIG. 8 was manufactured.

Evaluation

Evaluation of the common mode choke coils of example 1 and comparative example 1 was performed as described below.

Inductance

Figure 10:
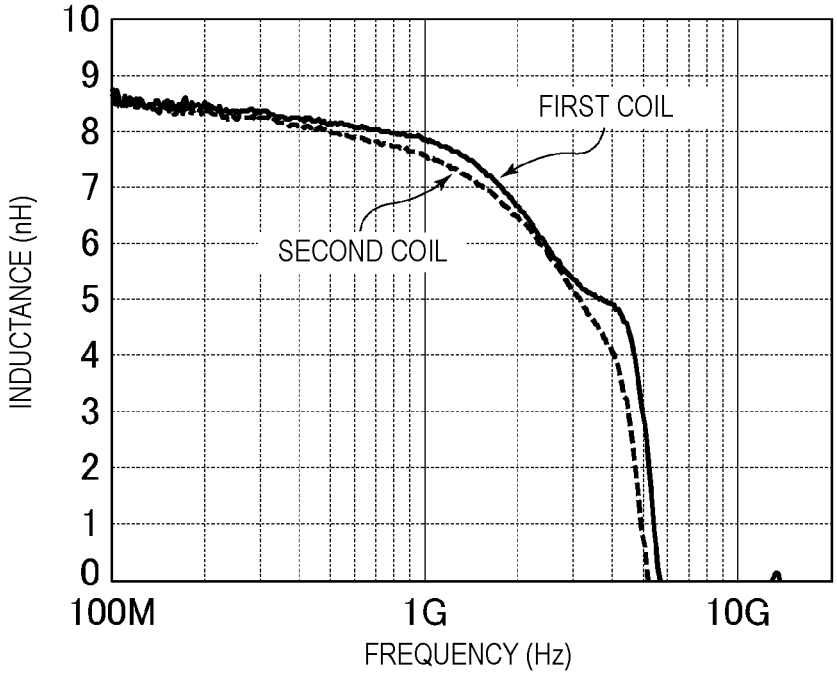
FIG. 10 is a graph illustrating the inductance-frequency characteristics of a first coil and a second coil of a common mode choke coil of example 1.
Figure 11:
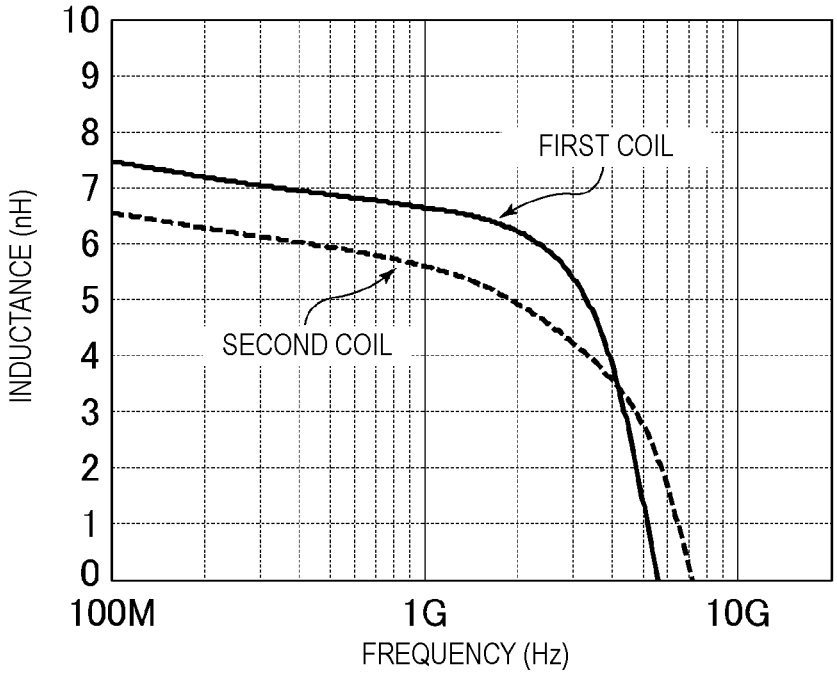
FIG. 11 is a graph illustrating the inductance-frequency characteristics of a first coil and a second coil of a common mode choke coil of comparative example 1.

The inductances of the first coils and the second coils of the common mode choke coils were measured using the above-described method and the frequency characteristics were evaluated. FIG. 10 is a graph illustrating the inductance-frequency characteristics of the first coil and the second coil of the common mode choke coil of example 1. FIG. 11 is a graph illustrating the inductance-frequency characteristics of the first coil and the second coil of the common mode choke coil of comparative example 1.

Next, when L1 and L2 represent the measured values of the inductances of the first coil and the second coil and the degree of deviation between these inductances was evaluated by calculating $100\times|L1-L2|/((L1+L2)/2)$. This evaluation was carried under conditions of frequencies of 1 GHz and 100 MHz. The obtained results are illustrated in Table 1.

Impedance

Figure 12:
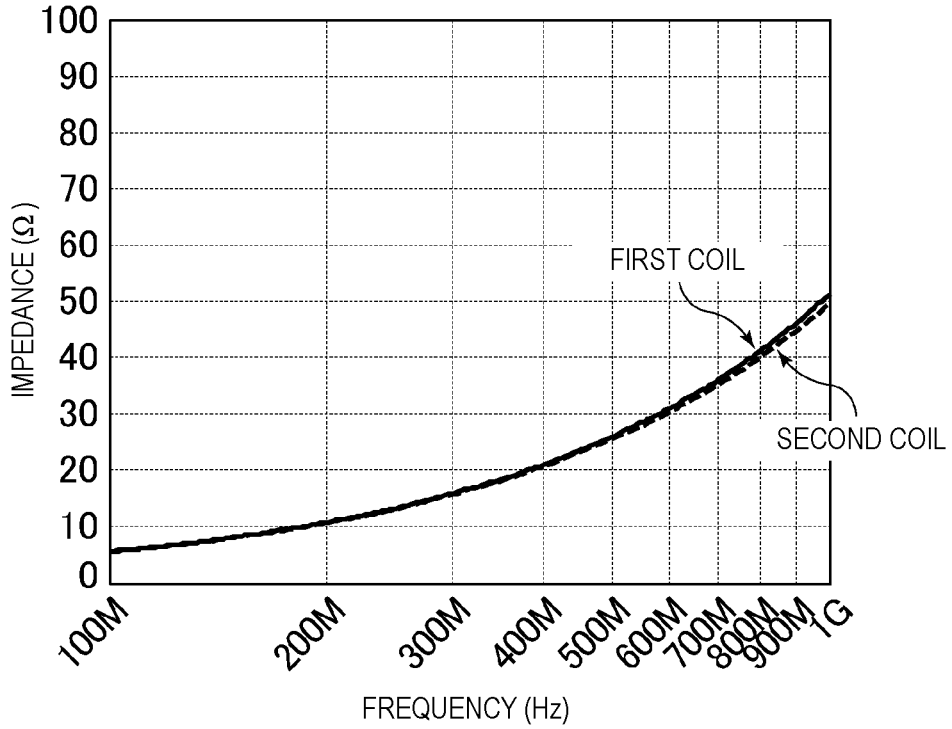
FIG. 12 is a graph illustrating the impedance-frequency characteristics of the first coil and the second coil of the common mode choke coil of example 1.
Figure 13:
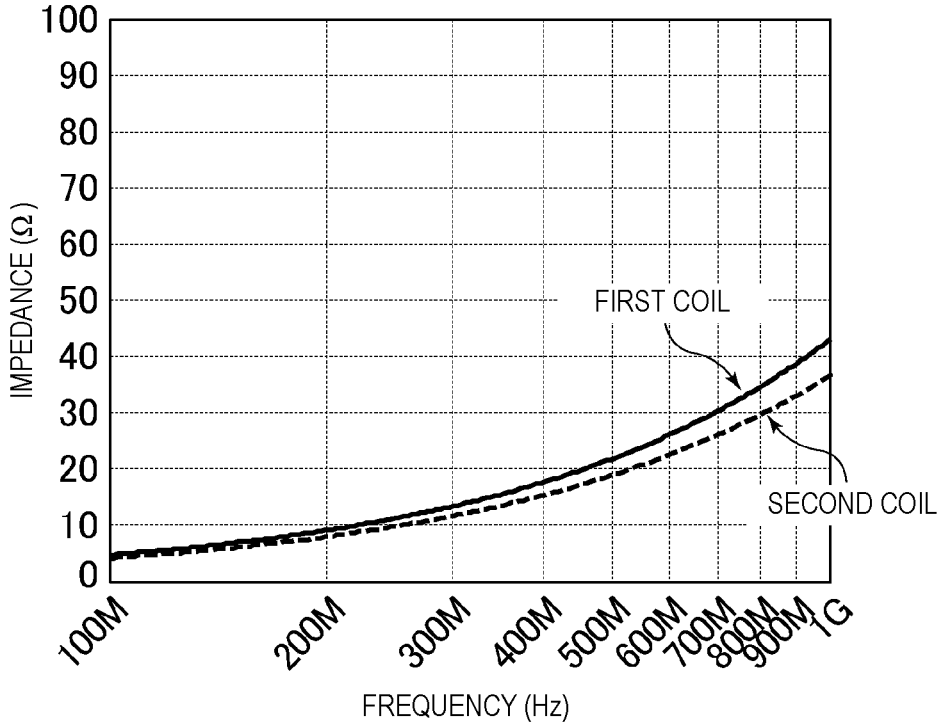
FIG. 13 is a graph illustrating the impedance-frequency characteristics of the first coil and the second coil of the common mode choke coil of comparative example 1.

The impedances of the first coils and the second coils of the common mode choke coils were measured using the above-described method and the frequency characteristics were evaluated. FIG. 12 is a graph illustrating the impedance-frequency characteristics of the first coil and the second coil of the common mode choke coil of example 1. FIG. 13 is a graph illustrating the impedance-frequency characteristics of the first coil and the second coil of the common mode choke coil of comparative example 1.

Next, Z1 and Z2 represent the measured values of the impedances of the first coil and the second coil and the degree of deviation between these impedances was evaluated by calculating $100\times|Z1-Z2|/((Z1+Z2)/2)$. This evaluation was carried under conditions of frequencies of 1 GHz and 100 MHz. The obtained results are illustrated in Table 1.

TABLE 1

| | | Example 1 | | | Comparative Example 1 | | |
|---|---|---|---|---|---|---|---|
| | Frequency (Hz) | First Coil | Second Coil | Deviation (%) | First Coil | Second Coil | Deviation (%) |
| Inductance | 100 MHz | 8.74 | 8.65 | 1.0 | 7.46 | 6.55 | 13.0 |
| (nH) | 1 GHz | 7.84 | 7.56 | 3.6 | 6.64 | 5.59 | 17.2 |
| Impedance | 100 MHz | 5.71 | 5.66 | 0.9 | 4.73 | 4.15 | 13.1 |
| (Ω) | 1 GHz | 51.3 | 49.7 | 3.2 | 43.1 | 36.6 | 16.3 |

As illustrated in Table 1, the degree of deviation between the inductance of the first coil and the inductance of the second coil was smaller in the common-mode choke coil of example 1 than in the common-mode choke coil of comparative example 1. In addition, as illustrated in FIGS. 10 and 11, the common mode choke coil of example 1 exhibited frequency characteristics in which the inductance of the first coil and the inductance of the second coil were closer to each other than in the common mode choke coil of comparative example 1.

As illustrated in Table 1, the degree of deviation between the impedance of the first coil and the impedance of the second coil was smaller in the common-mode choke coil of example 1 than in the common-mode choke coil of comparative example 1. In addition, as illustrated in FIGS. 12 and 13, the common mode choke coil of example 1 exhibited frequency characteristics in which the impedance of the first coil and the impedance of the second coil were closer to each other than in the common mode choke coil of comparative example 1.

Path Length

The path lengths of the first and second coils of the common mode choke coils were measured using the method described above and the respective measured values were represented by R1 and R2. The degree of deviation between these path lengths was evaluated by calculating 100×(R1−R2)/R1 when R1≥R2 and 100×(R2−R1)/R2 when R2≥R1. As a result, the degree of deviation between the path length of the first coil and the path length of the second coil was 2.1% in the common mode choke coil of example 1 and 6.4% in the common mode choke coil of comparative example 1.

From the above evaluation results, it was found that the common mode choke coil of example 1 had a superior noise suppression function than the common mode choke coil of comparative example 1.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil comprising:

an element body including a plurality of insulating layers stacked in a height direction;

a first coil and a second coil that are built into the element body;

a first outer electrode that is provided on a surface of the element body and is electrically connected to one end of the first coil;

a second outer electrode that is provided on a surface of the element body at a position that faces the first outer electrode in a width direction that is perpendicular to the height direction and that is electrically connected to another end of the first coil;

a third outer electrode that is provided on a surface of the element body and is electrically connected to one end of the second coil; and a fourth outer electrode that is provided on a surface of the element body at a position that faces the third outer electrode in the width direction and that is electrically connected to another end of the second coil;

wherein

100× |L1−L2|/((L1+L2)/2)≤5 at 1 GHz, where L1 is an inductance of the first coil and L2 is an inductance of the second coil;

100×(R1−R2)/R1≤3 when R1≥R2 and 100×(R2−R1)/R2≤3 when R2≥R1, where R1 is a path length of the first coil and R2 is a path length of the second coil, first, second, third and fourth extension electrodes extend from the first, second, third, and fourth outer electrodes, respectively, the path length of the first coil includes a total length of wiring line connected between the first extension electrode and the second extension electrode, and the path length of the second coil includes a total length of a wiring line connected between the third extension electrode and the fourth extension electrode.

2. The common mode choke coil according to claim 1, wherein

100×|L1−L2|/((L1+L2)/2)≤3 at 100 MHz.

3. A common mode choke coil comprising:

an element body including a plurality of insulating layers stacked in a height direction;

a first coil and a second coil that are built into the element body;

a first outer electrode that is provided on a surface of the element body and is electrically connected to one end of the first coil;

a second outer electrode that is provided on a surface of the element body at a position that faces the first outer electrode in a width direction that is perpendicular to the height direction and that is electrically connected to another end of the first coil;

a third outer electrode that is provided on a surface of the element body and is electrically connected to one end of the second coil; and a fourth outer electrode that is provided on a surface of the element body at a position that faces the third outer electrode in the width direction and that is electrically connected to another end of the second coil;

wherein

100×|L1−L2|/((L1+L2)/2)≤5 at 1 GHz, where L1 is an inductance of the first coil and L2 is an inductance of the second coil, the first coil includes a plurality of coil conductors that are stacked, the coil conductors of the first coil including a first coil conductor and a second coil conductor, together with insulating layers in the height direction and electrically connecting the coil conductors to each other, the first coil conductor includes a first line portion and a first land portion, one end of the first line portion is connected to a first extension electrode that extends from the first outer electrode, another end of the first line portion is connected to the first land portion from a side that is near the first extension electrode in the width direction, the second coil conductor includes a second line portion and a second land portion that is electrically connected to the first land portion, one end of the second line portion is connected to a second extension electrode that extends from the second outer electrode, another end of the second line portion is connected to the second land portion from a side that is near the second extension electrode in the width direction, the second coil includes a plurality of coil conductors that are stacked, the coil conductors of the second coil including a third coil conductor and a fourth coil conductor, together with insulating layers in the height direction and electrically connecting the coil conductors to each other, the third coil conductor includes a third line portion and a third land portion, one end of the third line portion is connected to a third extension electrode that extends from the third outer electrode, another end of the third line portion is connected to the third land portion from a side that is near the third extension electrode in the width direction, the fourth coil conductor includes a fourth line portion and a fourth land portion that is electrically connected to the third land portion, one end of the fourth line portion is connected to a fourth extension electrode that extends from the fourth outer electrode, and another end of the fourth line portion is connected to the fourth land portion from a side that is near the fourth extension electrode in the width direction.

4. The common mode choke coil according to claim 1, wherein one coil diameter out of a coil diameter of the first coil and a coil diameter of the second coil is smaller than the other coil diameter.

5. The common mode choke coil according to claim 1, wherein L1 and L2 both lie in a range from 1 nH to 10 nH.

6. The common mode choke coil according to claim 1, wherein the insulating layers are composed of a glass ceramic material.

7. The common mode choke coil according to claim 1, wherein the first coil includes a plurality of coil conductors that are stacked, the coil conductors of the first coil including a first coil conductor and a second coil conductor, together with insulating layers in the height direction and electrically connecting the coil conductors to each other, the first coil conductor includes a first line portion and a first land portion, one end of the first line portion is connected to the first extension electrode that extends from the first outer electrode, another end of the first line portion is connected to the first land portion from a side that is near the first extension electrode in the width direction, the second coil conductor includes a second line portion and a second land portion that is electrically connected to the first land portion, one end of the second line portion is connected to the second extension electrode that extends from the second outer electrode, another end of the second line portion is connected to the second land portion from a side that is near the second extension electrode in the width direction, the second coil includes a plurality of coil conductors that are stacked, the coil conductors of the second coil including a third coil conductor and a fourth coil conductor, together with insulating layers in the height direction and electrically connecting the coil conductors to each other, the third coil conductor includes a third line portion and a third land portion, one end of the third line portion is connected to the third extension electrode that extends from the third outer electrode, another end of the third line portion is connected to the third land portion from a side that is near the third extension electrode in the width direction, the fourth coil conductor includes a fourth line portion and a fourth land portion that is electrically connected to the third land portion, one end of the fourth line portion is connected to the fourth extension electrode that extends from the fourth outer electrode, and another end of the fourth line portion is connected to the fourth land portion from a side that is near the fourth extension electrode in the width direction.

8. The common mode choke coil according to claim 3, wherein one coil diameter out of a coil diameter of the first coil and a coil diameter of the second coil is smaller than the other coil diameter.

9. The common mode choke coil according to claim 2, wherein

L1 and L2 both lie in a range from 1 nH to 10 nH.

10. The common mode choke coil according to claim 3, wherein

L1 and L2 both lie in a range from 1 nH to 10 nH.

11. The common mode choke coil according to claim 4, wherein

L1 and L2 both lie in a range from 1 nH to 10 nH.

12. The common mode choke coil according to claim 7, wherein

L1 and L2 both lie in a range from 1 nH to 10 nH.

13. The common mode choke coil according to claim 2, wherein the insulating layers are composed of a glass ceramic material.

14. The common mode choke coil according to claim 3, wherein the insulating layers are composed of a glass ceramic material.

15. The common mode choke coil according to claim 4, wherein the insulating layers are composed of a glass ceramic material.

16. The common mode choke coil according to claim 5, wherein the insulating layers are composed of a glass ceramic material.

* * * * *